United States Patent [19]

Erlendsson et al.

[11] Patent Number: 5,009,019

[45] Date of Patent: Apr. 23, 1991

[54] SIGN PLATE FOR ILLUMINATED SIGN

[75] Inventors: Gudni Erlendsson, Graves Strand; Thorgeir D. Hjaltason, Copenhagen, both of Denmark

[73] Assignee: Rite Lite Partnership, Chicago, Ill.

[21] Appl. No.: 454,746

[22] Filed: Dec. 21, 1989

[30] Foreign Application Priority Data

Dec. 21, 1988 [DK] Denmark ..... 7136

[51] Int. Cl.[5] ..... G09F 13/00

[52] U.S. Cl. ..... 40/541; 40/580; 40/583; 40/542; 40/543

[58] Field of Search ..... 40/543, 542, 546, 570, 40/582, 583, 541, 580

[56] References Cited

U.S. PATENT DOCUMENTS

| | | | |
|---|---|---|---|
| 1,725,206 | 8/1929 | Peterson | 40/542 |
| 1,887,523 | 11/1932 | Schenkel | 40/570 |
| 2,071,239 | 2/1937 | Spencer et al. . | |
| 2,262,930 | 11/1941 | Gasper | 40/546 |
| 2,594,903 | 4/1952 | Freedman | 40/543 |
| 2,689,917 | 9/1954 | Switzer | 40/543 |
| 2,810,225 | 10/1957 | Hardesty | 40/546 |
| 3,583,298 | 6/1971 | Swearingen | 40/542 |
| 3,978,599 | 9/1976 | Berger . | |
| 4,424,449 | 1/1984 | O'Brill | 40/542 |
| 4,891,896 | 1/1990 | Boren . | |

FOREIGN PATENT DOCUMENTS

| | | | |
|---|---|---|---|
| 3729918 | 3/1989 | Fed. Rep. of Germany | 40/542 |

*Primary Examiner*—Rodney M. Lindsey
*Assistant Examiner*—F. Saether
*Attorney, Agent, or Firm*—Fitch, Even, Tabin & Flannery

[57] ABSTRACT

A sign plate for an illuminated sign having a light source includes an opaque layer on one of its faces which layer is broken by zones corresponding to a configuration of text or figures to be communicated, the zones being covered with fluorescent material, and the surface of the fluorescent material facing the viewer and opposite the light source being covered with a light reflective layer.

7 Claims, 1 Drawing Sheet

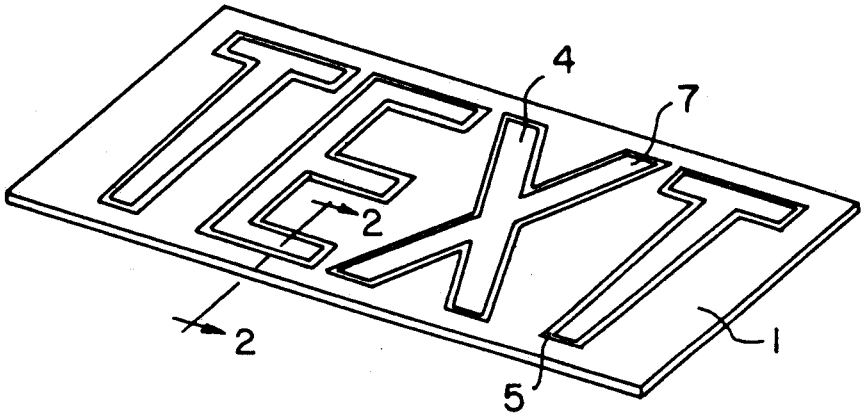
FIG. 1
FIG. 2
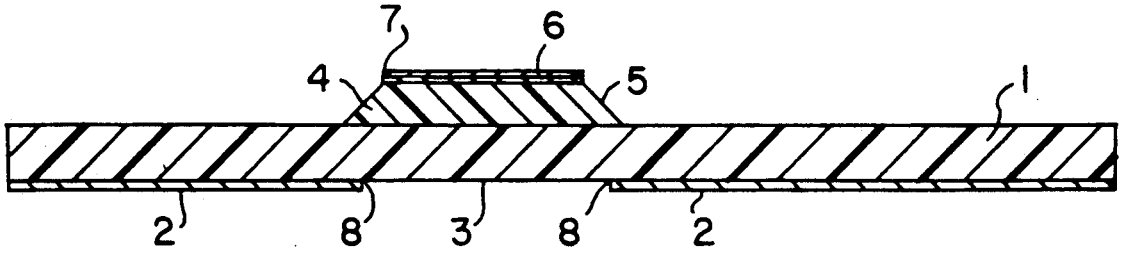

SIGN PLATE FOR ILLUMINATED SIGN

This invention relates to an illuminated sign having a sign plate that includes a base of ultraviolet transmitting material with an opaque layer or coating on it. The integrity of the opaque layer is broken by zones into a configuration that defines the message or matter being communicated by the sign. The sign plate also includes fluorescent material that glows upon activation by a light source, such as an ultraviolet light.

Such an illuminated sign has been described in Danish Patent Application No. 4729/87, published under the Patent Cooperation Treaty in publication WO-A-89/02637 on Mar. 23, 1989. That sign plate consists of a transparent or ultraviolet translucent plate or sheet, the front side of which is covered with an ultraviolet-opaque layer or coating broken into zones corresponding to a text or a figure. Grooves are cut into the transparent sign plate around these zones, and strings of fluorescent plastic material are set into these grooves.

A principle purpose of this invention is to provide an illuminated sign of the general type described above, but which includes an aura around the outline of the configuration being communicated and a construction of the sign plate that is easier to produce than that of the sign plate in the known sign.

In accordance with this invention, the foregoing is achieved with an illuminated sign wherein fluorescent material totally covers the broken zones in the ultraviolet-opaque layer on the sign plate, and a layer of light reflective material is placed on the surface of the fluorescent material that faces the viewer.

When the rear of the sign plate, i.e. the face of the sign plate opposite the viewer, is illuminated with an ultraviolet light source, the light rays pass forward through the broken zones of the ultraviolet-opaque layer and into the fluorescent material, activating the fluorescent material. The light from the activated fluorescent material then reflects off the light reflective layer on the front of the fluorescent material, and part of these reflected rays pass through the exposed side edges of the fluorescent material, while other rays are reflected backward to strike the front of the ultraviolet-opaque layer on the ultraviolet transmitting plate and from there are reflected forward toward the viewer.

The effect achieved in this construction for a viewer facing the sign plate is that of glowing outlines and aura around the configuration of the matter being communicated, such as text or figures or art work.

This is of a far different nature from that of the known sign plate, for example, in U.S. Pat. No. 3,978,599 to Berger wherein the text material projects rearwardly away from the viewer and toward the light source to gather light and enhance the amount of light seen directly by the viewer revealing the whole of the configuration of broken zones in the opaque layer. No light reflective surface covers the openings of these broken zones, and so the viewer sees the whole text lighted rather than an outline and aura around the text.

This also is of a far different nature from that of the sign plate disclosed in U.S. Pat. No. 2,071,239 to Spencer et al., wherein an excavating operation (preferably performed by sand blast) is utilized to form a design, letter or legend out of solid bodies of glass which then protrude in bold relief from a roughened temporary surface left by the sand blasting operation to form protruding lens-like bodies of translucent or transparent material standing out in strong relief with respect to a background of contrasting character. It appears that the ambient light reflects variously from the resulting differing surfaces to create certain effects.

The structure of this invention, on the other hand, creates a particularly strong outline with aura of the matter to be communicated, especially if the side edges of the fluorescent material are in general registry with the configuration of the broken zones and are inclined in relation to the sign plate's front face. Some of the light rays from the activated fluorescent material are directed out the inclined side edges which border the front reflective surface of the text and outline the configuration. Others of the light rays are reflected backward to reflect forward toward the viewer from the front of the ultraviolet-opaque layer on the ultraviolet transmitting base plate to create the aura around the outline. The inclined edges preferably should form an angle of about 120° to about 150° with respect to the front face of the sign plate.

It is preferred that the fluorescent material be cut slightly larger than the corresponding broken zones in the ultraviolet-opaque layer to assure registry with and full coverage of the broken zone configuration so that light from the source will not escape directly out through the sign plate along the sides of the of the fluorescent material and thereby avoid activating the fluorescent material.

The configuration of fluorescent material is easy to produce. For example, it can be mill-cut in an automatic process, or it can be molded or cast.

It should be appreciated that producing the above mentioned configuration of fluorescent material and affixing it to the sign face is a much simpler process than shown and described, for example, in the aforementioned U.S. Pat. Nos. 3,978,599 and 2,071,239 and Danish Patent Application No. 4729/87.

According to the invention, the text or figure or art work will be exceptionally clear if in addition a layer of color is placed on front of the front light reflective layer, especially if the color is different from that of the rest of the sign plate.

In a preferred structure, the opaque layer is provided on the rear of the foundational or basic light transmitting plate, but with a layer of color first applied intermediate the rear face of the light transmitting plate and the front face of the opaque layer. This structure allows the color to be seen through the light transmitting plate from the front, giving the sign its base color. Preferably, the opaque layer is also of a light reflective material or at least includes a light reflective layer on its rear face to receive and reflect light from the light source and increase the overall light emission from the sign plate when in its mounted, operational condition.

The aforementioned layers can be either ink applied by a suitable process, such as by a silk screen, or be totally adherent foils, or a combination of both.

A more detailed description of a preferred embodiment includes reference to the drawing, wherein:

FIG. 1 a perspective view of a sign plate in accordance with this invention; and FIG. 2 is a partial sectional view of the sign plate according to the invention taken along the line II—II of FIG. 1.

Referring now to the drawing, a preferred embodiment of the sign plate of the invention includes an ultraviolet light transmitting plate 1 which provides the basic structure for the sign plate. Preferably, the light transmitting plate 1 is made of ultraviolet transmitting acrylic plastic. The plate 1 is provided with an opaque reflective layer 2 on one of its faces. The top face as viewed in the drawing in both FIGS. 1 and 2 is the front face or surface of the sign plate and is the face seen by a viewer when the sign is mounted for illumination in a box or other suitable structure along with a light source for display. In FIG. 2 the opaque layer 2 is illustrated as applied to the back or rear face or surface of the light transmitting plate 1. It should be understood, however, that this if for purposes of illustration and that the layer 2 could also be applied to the front surface of the plate in accordance with the invention.

The word "text" is spelled out on the front face of a light transmitting plate 1 in FIG. 1, and this is representative of matter that is to be visually communicated by the sign when installed and illuminated. In addition to letters, this matter also might include figures, ornaments, legends and the like. The detail that forms the matter to be communicated includes broken zones 3 in the integrity of the opaque layer 2. The broken zones form a configuration that defines the matter to be communicated. In register with this configuration of broken zones is a projecting detail 4 that forms a relief with respect to the front surface of the plate 1. The projection 4 is preferably made of a fluorescent material, such as fluorescent acrylic plastic. The projection 4 may be affixed in registry with the broken zones 3 by any suitable means, such as bonding to the front surface of the plate 1 by an acrylic adhesive.

The projection 4 has inclined side edges 5, and the width of the base of the projection 4 is preferably slightly more than the width of the broken zones 3 in the reflective layer 2. The projection 4 has a configuration that matches the configuration of the broken zones 3. The slight additional width therefore assures complete coverage of the configuration of the broken zones 3 by the configuration of the projection 4. As will be seen hereinafter, when the rear of the plate 1 is exposed to light, the light will pass through the broken zones 3 of the opaque layer 2 and activate the fluorescent material of the projection 4. Without complete coverage of the zones 3 by the projection 4, some light could bypass the fluorescent material and decrease the effectiveness of the invention. The front of the projection 4 is provided with a light reflective layer 6. This layer 6 could be an opaque ink applied by a suitable means, such as be a silk screen process, or it could be a foil. Further, a layer 7 of color is applied on the front of the light reflective layer 6.

On the rear of the sign plate 1, sandwiched between the rear surface of the sign plate 1 and the reflective layer 2, is a color layer 8 which, through the transparency of the sign plate 1, determines the base color of the sign. The front color layer 7 may be selected to coordinate with the base color layer 8.

By exposing the sign plate 1 to a light source (not shown), preferably an ultraviolet light source behind the sign plate 1 (below the views as seen in the drawing), some light rays will reflect directly from the reflective layer 2 on the rear of the sign plate 1. Others of the ultraviolet rays will pass into the transparent plate 1 through the broken zones 3 in the reflective layer 2 and into the projection 4 to activate the fluorescent material and make it glow. Part of the light rays produced from the activation of the fluorescent material will escape through the inclined side edges 5. When viewed front on, the effect is to give a distinct illuminated outline of the configuration defining the matter being communicated.

The remaining ultraviolet rays produced from the activation of the fluorescent material will be reflected by the reflective layer 6 to strike the front surface of the reflective layer 2 and reflect to the front of the sign. These rays will appear as an aura around the configuration defining the matter being communicated, on the colored background 8. The aura is enhanced when the opaque layer 2 is applied to the rear of the plate 1. Hence, overall, the structure shown in the drawing is preferable. The layer 2 is preferably for both opacity and reflectance.

The principle of the sign plate disclosed herein has many applications according to the creativeness of the person applying the principle. For example, in addition to the more usual applications of applying the principle to artistic displays, information dissemination and advertising, the principle could be applied to faces for clocks and relief maps and globes.

Although the invention has been particularly shown and described with reference to preferred embodiments thereof, it will be understood by those skilled in the art that various changes in the form and details may be made therein without departing from the spirit and scope of the invention which is defined by the following claims.

What is claimed is:

1. A sign plate for an illuminated sign having a light source and visual communication matter illuminated thereby, the sign plate comprising:

a sheet of ultraviolet-transmitting material having a front face for attracting a viewer's eye and a rear face for receiving rays from the light source;

an opaque reflective layer applied to one face of the sheet, the integrity of the layer being broken by zones forming a configuration that defines the matter to be communicated, a fluorescent material for activation by the light source, the fluorescent material having front and rear surfaces with edges joining these surfaces, the edges forming the outline of the configuration that defines the matter to be communicated, the rear surface of the fluorescent material being affixed to the front face of the sheet such that the fluorescent material is in register with and fully covering the zones forming the configuration in the opaque layer; and an opaque light reflective layer applied to the front surface of the fluorescent material without completely covering the zones, the light reflective layer (1) creating a core area in the midst of the outline, which, when subjected to the light source is unilluminated from the viewer's perspective by the light source and (2) causing an aura around the configuration when subjected to the light source resulting in an enhancement of the illuminated outline from the viewer's perspective.

2. A sign plate according to claim 1 wherein the fluorescent material is sheet formed, the front and rear surfaces thereof being parallel and planar and further comprising a layer of color on the front face of the light reflective layer.

3. A sign plate according to claim 1 wherein the edges of the fluorescent material form an angle exceeding 90° with respect to the front of the sign plate.

4. A sign plate according to claim 2 wherein the edges of the fluorescent material form an angle exceeding 90° with respect to the front of the sign plate.

5. A sign plate according to claim 3, wherein the fluorescent material affixed to the sign plate is wider than the corresponding width of the zones forming the configuration in the opaque layer.

6. A sign plate according to claim 4, wherein the fluorescent material affixed to the sign plate is wider than the corresponding width of the zones forming the configuration in the opaque layer.

7. A sign plate according to any of the above claims wherein the sign plate construction includes ultraviolet transmitting acrylic plastic and the opaque layer is on the rear face of the plate, and further comprising a layer of color applied intermediate the rear face and the opaque layer.

* * * * *